US011574616B2

(12) United States Patent
Baker

(10) Patent No.: US 11,574,616 B2
(45) Date of Patent: Feb. 7, 2023

(54) ATTACHABLE STRING BENDER

(71) Applicant: Waylon Dale Baker, Plant City, FL (US)

(72) Inventor: Waylon Dale Baker, Plant City, FL (US)

( * ) Notice: Subject to any disclaimer, the term of this patent is extended or adjusted under 35 U.S.C. 154(b) by 0 days.

(21) Appl. No.: 17/378,698

(22) Filed: Jul. 17, 2021

(65) Prior Publication Data

US 2022/0114990 A1 Apr. 14, 2022

Related U.S. Application Data

(60) Provisional application No. 63/053,567, filed on Jul. 17, 2020.

(51) Int. Cl.

| | |
|---|---|
| ***G10D 3/04*** | (2020.01) |
| ***G10D 3/153*** | (2020.01) |
| ***G10D 1/08*** | (2006.01) |

(52) U.S. Cl.
CPC ..... *G10D 3/153* (2020.02); *G10D 1/08* (2013.01); *G10D 3/04* (2013.01)

(58) Field of Classification Search
CPC ..... G10D 3/153; G10D 1/08; G10D 3/04
See application file for complete search history.

(56) References Cited

U.S. PATENT DOCUMENTS

2013/0180378 A1* 7/2013 Baker ..... G10D 3/153 84/313

* cited by examiner

*Primary Examiner* — Kimberly R Lockett
(74) *Attorney, Agent, or Firm* — Cygnet IP Law, P.A.; Stephen W. Aycock, II

(57) ABSTRACT

Some implementations can include a string bender including a body configured to attach to a bridge of a guitar or other stringed instrument. Some implementations can include a bridge with an integrated string bender. The string bender can be constructed to bend one or more strings, for example the B and/or G strings. The string bender can also be constructed to fit a variety of guitar styles, such as Fender Telecaster or Stratocaster-style guitars.

12 Claims, 28 Drawing Sheets

ATTACHABLE STRING BENDER

RELATED APPLICATIONS

This application claims the benefit of U.S. Provisional Application No. 63/053,567, entitled "String Bender," and filed on Jul. 17, 2020, which is incorporated herein by reference in its entirety.

FIELD

Embodiments relate generally to a string bender for stringed musical instruments, and, more particularly, to an attachable guitar string bender.

BACKGROUND

Bending, or changing the tension of, a guitar string to change the pitch of a note being played can be a technique used in certain styles of music, such as country. Some conventional string benders for guitars may require movement of the guitar body relative to a strap in order to activate a string bending mechanism. Other conventional string benders may require that the strumming/picking hand (e.g., typically the right hand of a right-handed player) be moved from a normal playing position in order to activate the bending mechanism.

Still other conventional string benders may require modification of the guitar body (e.g., drilling and/or cutting) in order to be mounted on the guitar.

Embodiments were conceived in light of one or more of the above-mentioned problems and limitations, among other things.

SUMMARY

Some implementations include a string bender having a body configured to mount on a bridge of a guitar and to be secured using one or more attachment fasteners inserted through corresponding attachment apertures in the body, and a cam configured to fit within a first aperture of the body and to secure a string of the guitar, wherein when the cam is rotated from a first position to a second position, the cam changes tension of the string. The string bender can also include a rod configured to be inserted into a second aperture of the body and to extend through an aperture in the cam, wherein the rod includes a portion that extends beyond the body when the rod is fully inserted into the second aperture of the body, and wherein the cam includes a set screw to secure the cam to the rod, and a bar configured to attach to the portion of the bar that extends beyond the body, wherein the bar is attached to the rod via a set screw, wherein the bar is disposed on the body adjacent a side of the guitar corresponding to a lowest pitch string of the guitar toward a top of the guitar and extends in a direction from the bridge toward a neck of the guitar, and wherein the bar is operative to rotate the rod and, in turn, the cam from the first position to the second position when the bar is pressed.

In some implementations, the bender can further include a tuning adjustment screw configured to be inserted into a tuning screw aperture in the body, wherein the tuning adjustment screw is configured to extend through the tuning screw aperture in the body and into the first aperture of the body, and wherein the tuning adjustment screw is adjustable to limit a range of movement of the cam within the first aperture of the body when the cam moves from the first position to the second position. In some implementations, the body can include one or more slots formed to receive a portion of the bridge of the guitar that extends into the one or more slots when the body is mounted on the bridge, and wherein the attachment fasteners are disposed so as to engage the portion of the bridge extending into the one or more slots when the attachment fasteners are tightened.

In some implementations, the cam can be configured to secure the string via a string aperture in the cam that string passes through. In some implementations, the bar can include a curved profile. In some implementations, the tuning screw aperture can be disposed on a top side of the body.

Some implementations can include a string bender have a body configured to mount on a bridge of a stringed instrument and to be secured using one or more attachment fasteners inserted through corresponding attachment apertures in the body, and a cam configured to fit within a first aperture of the body and to secure a string of the stringed instrument, wherein when the cam is rotated from a first position to a second position, the cam changes tension of the string.

The string bender can also include a rod configured to be inserted into a second aperture of the body and to extend through an aperture in the cam, wherein the rod includes a portion that extends beyond the body when the rod is fully inserted into the second aperture of the body, and wherein the cam includes a set screw to secure the cam to the rod, and a bar configured to attach to the portion of the bar that extends beyond the body, wherein the bar is attached to the rod via a set screw, wherein the bar is disposed on the body adjacent a side of the stringed instrument corresponding to a lowest pitch string of the stringed instrument toward a top of the stringed instrument and extends in a direction from the bridge toward a neck of the stringed instrument, and wherein the bar is operative to rotate the rod and, in turn, the cam from the first position to the second position when the bar is pressed.

In some implementations, the bender can also include a tuning adjustment screw configured to be inserted into a tuning screw aperture in the body, wherein the tuning adjustment screw is configured to extend through the tuning screw aperture in the body and into the first aperture of the body, and wherein the tuning adjustment screw is adjustable to limit a range of movement of the cam within the first aperture of the body when the cam moves from the first position to the second position. In some implementations, the body can include one or more slots formed to receive a portion of the bridge of the stringed instrument that extends into the one or more slots when the body is mounted on the bridge, and wherein the attachment fasteners are disposed so as to engage the portion of the bridge extending into the one or more slots when the attachment fasteners are tightened.

In some implementations, the cam can be configured to secure the string via a string aperture in the cam that string passes through. In some implementations, the bar can include a curved profile. In some implementations, the tuning screw aperture can be disposed on a top side of the body.

DETAILED DESCRIPTION

In general, an embodiment can include a string bender for bending one or more strings of a stringed musical instrument, such as a guitar. The string bender can have one or more bars for activating the bending mechanism. The one or more bars can be disposed at or near a location where the palm of the picking/strumming hand of a player would normally rest when playing the guitar.

Some implementations can include a single string bender for bending the "B" or "G" strings of a guitar having conventional string tuning. The single string benders can be constructed to mount on a Fender-style guitar, such as a Telecaster or Stratocaster, or the like, for example.

It will be appreciated that an embodiment can be constructed to bend strings other than the "B" and "G" strings. Also, an embodiment can be constructed to mount on guitars other than Fender-style guitars.

Figure 1:
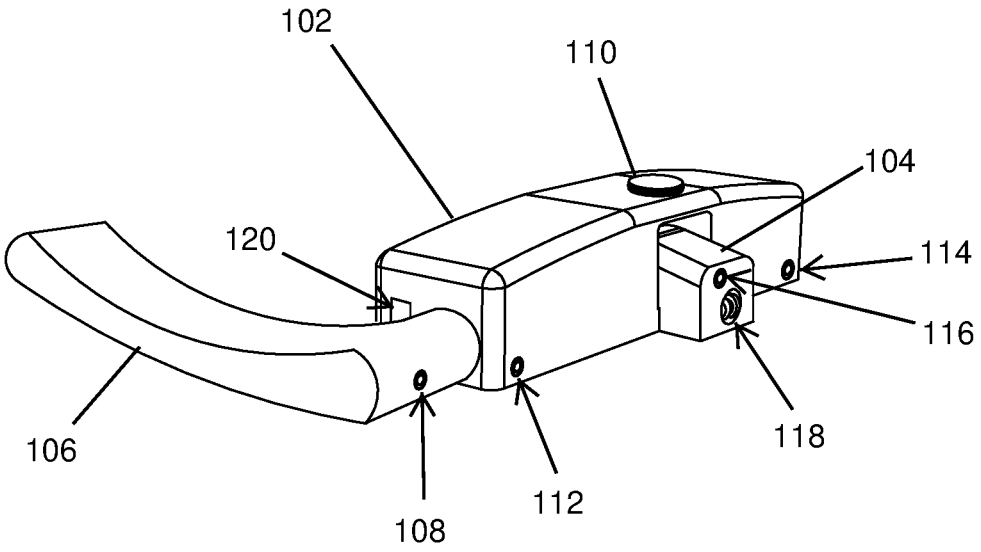
FIG. 1 is a side perspective view of an example attachable string bender in accordance with some implementations.
Figure 2:
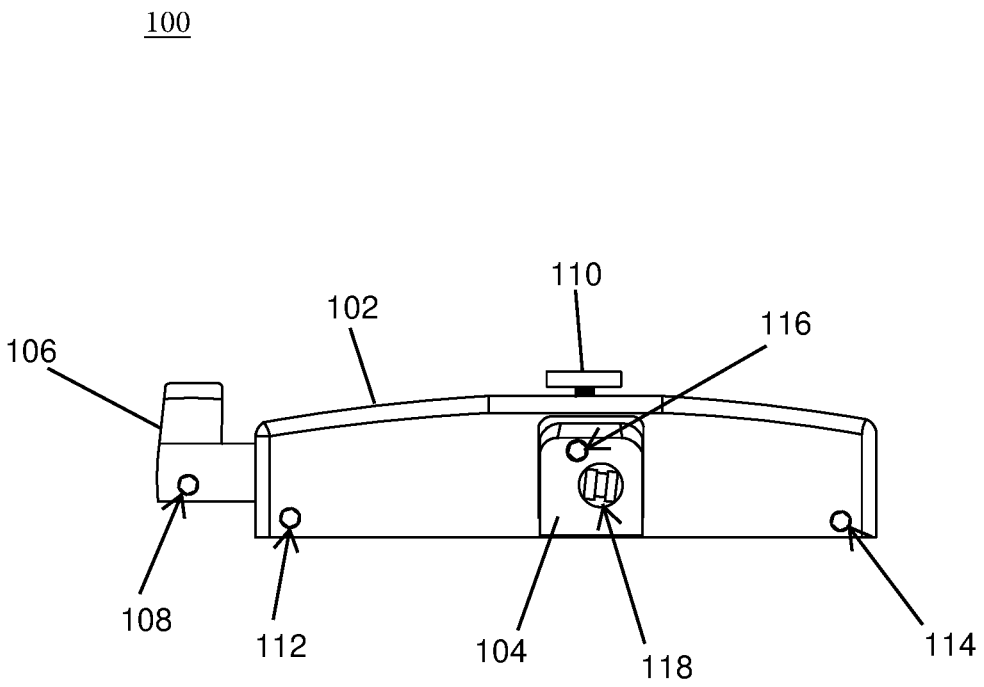
FIG. 2 is a back view of an example attachable string bender in accordance with some implementations.

FIGS. 1 and 2 show an example attachable string bender 100 in accordance with some implementations. The attachable string bender 100 includes a body 102, a cam 104, a bar 106, a bar set screw 108, a tuning screw 110, a first body set screw 112, a second body set screw 114, a cam set screw 116, a cam string aperture 118, and a body slot 120. FIG. 2 is a rear view of an example attachable string bender in accordance with some implementations.

In operation, a player can put pressure on the bar 106 to cause the bar to rotate and, in turn, to rotate a cam (e.g., 104) to a second or rotated position and cause tension in a corresponding string to change (e.g., to increase, thus raising the pitch of a note being played, or to be played). When pressure on the bar is released, the moveable portion returns to a first resting position and the string tension (and hence the pitch) return to approximately the same value as before the bar was pressed. While the bender is described herein as raising the pitch of string by increasing tension, the bender could be constructed to lower the pitch of one or more strings by reducing the tension in one or more strings.

The location of the bar 106 toward the top of the guitar body (e.g., above the low E string on a standard tuned guitar) and near the stop tailpiece and pickup permit a player to keep his/her strumming/picking hand in a common playing position and still be able to bend a string. Further, because the string bending mechanism does not rely on movement of the guitar body relative to the strap, the guitar body can remain in a normal playing position and no strap tension change is required to bend a string. Also, the bridge attachable bender as described herein can permit a player to play in a seated position (e.g., in a studio setting) and still perform bender playing techniques.

Figure 3:
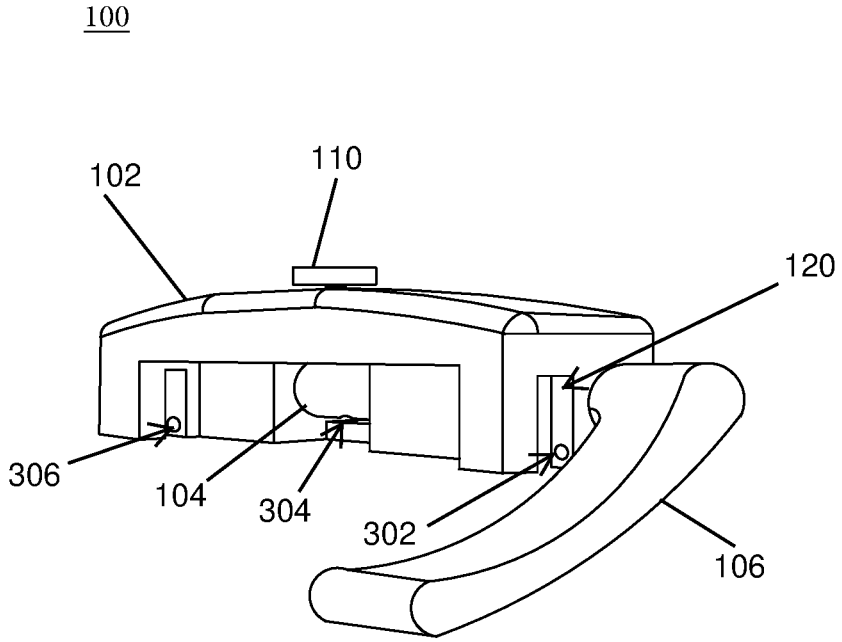
FIG. 3 is a front perspective view of an example attachable string bender in accordance with some implementations.

FIG. 3 is a front perspective view of the example attachable string bender 100 in accordance with some implementations. FIG. 3 shows the body set screw apertures 302 and 306. FIG. 3 also shows a string guide notch 304 in the cam 104.

Figure 4:
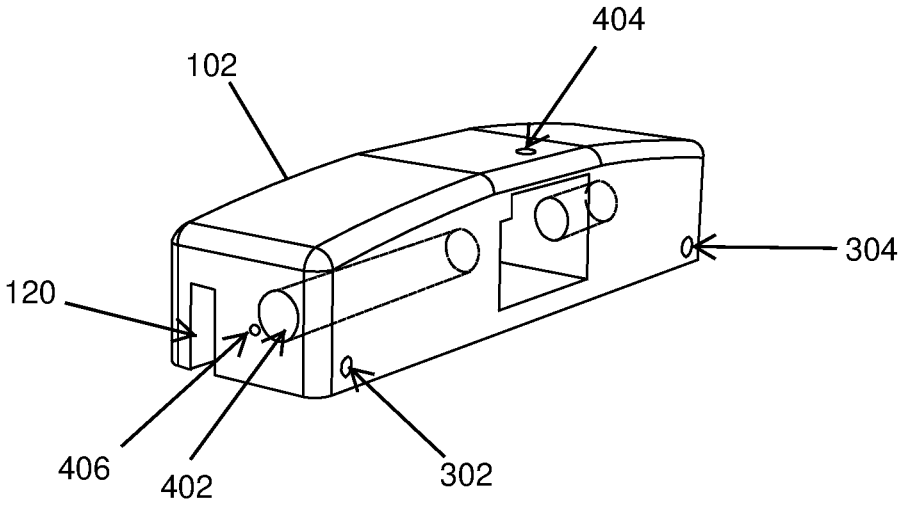
FIG. 4 is a perspective view of an example attachable string bender body in accordance with some implementations.

FIG. 4 is a perspective view of the example attachable string bender body 102 in accordance with some implementations. The body 102 includes a cylindrical aperture 402 configured to receive a rod. The body 102 also includes a tuning screw aperture 404. The body also includes an optional return spring anchor aperture 406.

Figure 5:
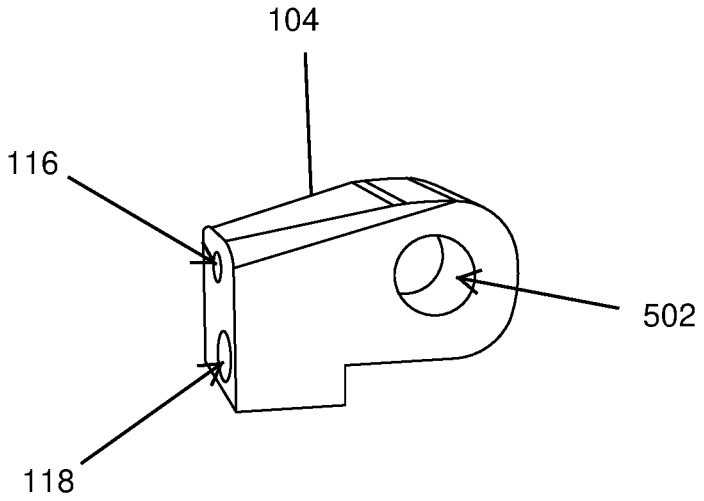
FIG. 5 is a perspective view of an example string bender cam in accordance with some implementations.

FIG. 5 is a perspective view of the example string bender cam 104 in accordance with some implementations. The cam 104 includes a cam rod aperture 502 to permit the rod to pass through the cam 104. A cam string aperture 118 that the string to be bent passes through. The cam string aperture 118 can be sized to permit the string to pass through while not permitting the string ball end to pass through, thus securing the string in place at the cam 104. The cam 104 also includes a cam set screw aperture 116 that permits the cam to be secured to the rod passing through 502.

The cam 104 can be configured to bend (or increase the tension of) a given string on the instrument (e.g., the g-string or b-string). In some implementations, the cam can include two or more string apertures (or two or more individual cams) such that the string bender has the capability to bend one of a plurality of strings corresponding to the string apertures or individual cams present, depending on which string is connected to a cam, or to simultaneously bend a plurality of strings when the plurality of strings are connected to the cam or cams.

Figure 6:
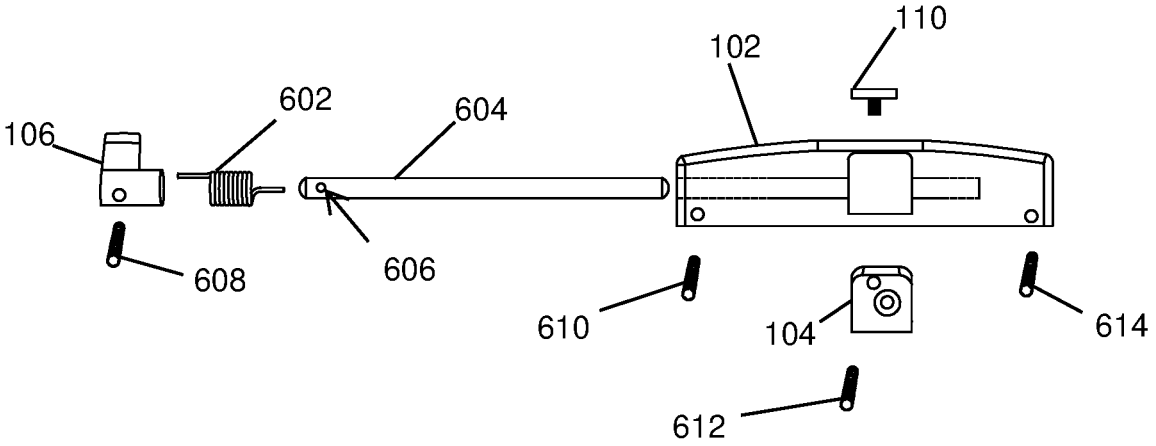
FIG. 6 is an exploded view of an example attachable string bender in accordance with some implementations.

FIG. 6 is an exploded view of an example attachable string bender in accordance with some implementations. FIG. 6 shows the bar 106, bar set screw 608 that is configured to be inserted into the bar set screw aperture 108 to secure the bar to a rod 604. An optional return spring 602 is provided to engage the bar 106 and provide return force to the bar 106 to help urge the bar from a rotated (or second position) to a non-rotated or first position. The return spring 602 is optional but can be helpful for returning the bent string to normal tuning more quickly (e.g., from the second position to the first position of the bar). The return spring 602 can engaged the bar 106 and be anchored in the return spring anchor aperture 406.

The rod 604 can include one or more apertures or flattened areas 606 to permit the set screw 608 to engage securely to the rod. The rod 604 can include a plurality of flat areas 606 that permit the bar to be set at an angle corresponding to each flat area so that the bar extends to different degrees above the guitar body to accommodate different player preferences.

The cam can be inserted into a recess area configured to receive the cam 104. The cam rod aperture 502 can be aligned with the cylindrical aperture 402 of the body 102. Once the apertures are aligned, the rod 604 can be inserted into the body 102 and the cam 104. The cam 104 can be secured to the rod by a cam set screw 612 that is inserted into the cam set screw aperture 116.

The body 102 can be secured to a bridge of a stringed instrument or guitar (as described below) via one or more set screws 610 and 614 that extend through set screw apertures 112 and 114, respectively in the body 102.

The amount of cam rotation from a first position (with the bar not pressed) to a second position (with the bar pressed) can be controlled by a tuning screw 110 inserted into the body 102 and extending into the recess that the cam 104 is in. The tuning screw adjusts the amount of cam movement and, in turn, the change in tension of the string being bent so as to adjust the final pitch of the string when bent.

Figure 7A:
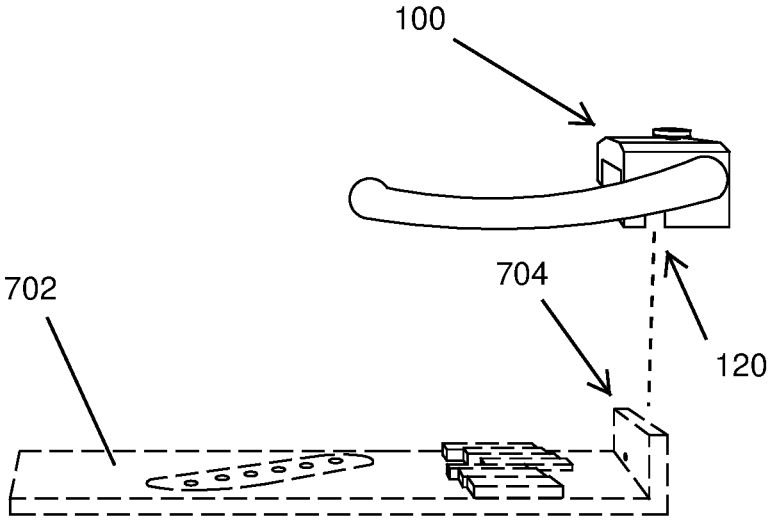
FIGS. 7A and 7B are views of an example attachable string bender being attached to a guitar bridge in accordance with some implementations.
Figure 7B:
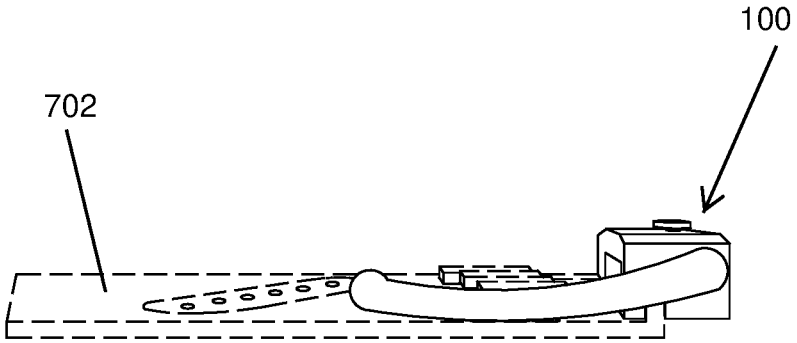

FIGS. 7A and 7B are views of an example attachable string bender 100 being attached to a guitar bridge 702 in accordance with some implementations. The tail piece 704 of the bridge 702 can fit into the slots 120 of the string bender 100 and secured in place as shown in FIG. 7B to the tail piece 704 via the set screws (e.g., 610 and 614).

Figure 8:
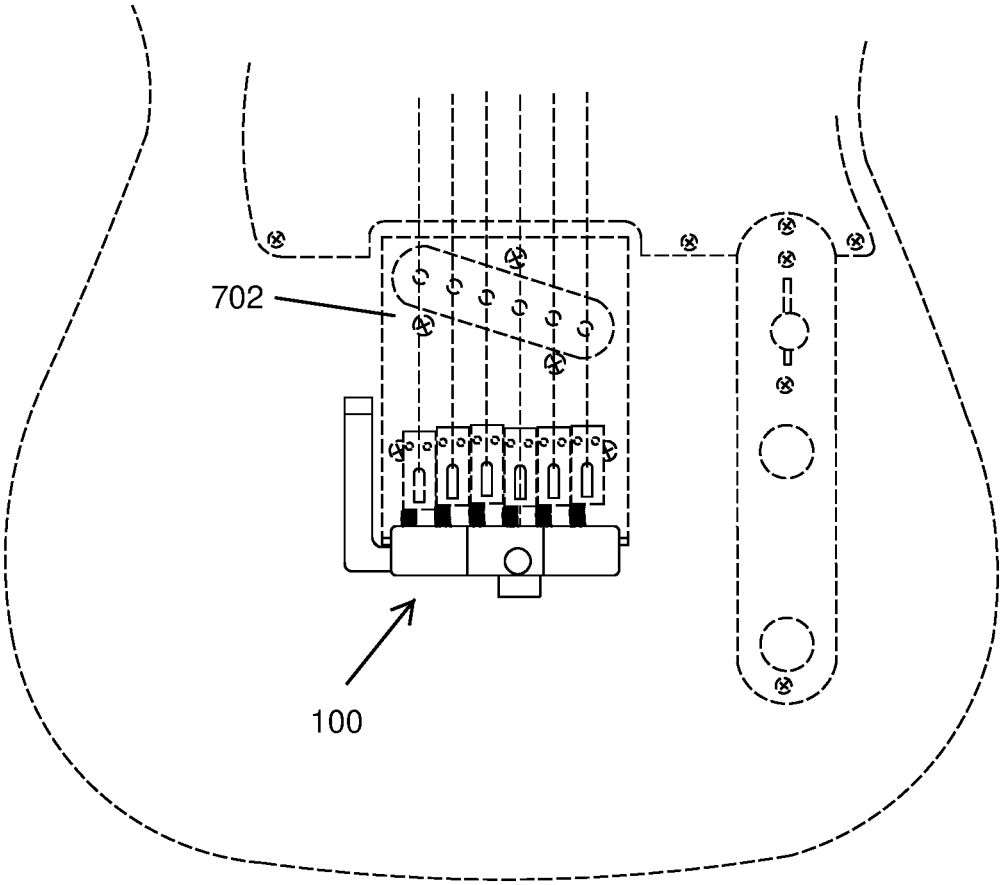
FIG. 8 shows an example attachable string bender attached to a guitar with a bridge having six saddles in accordance with some implementations.

FIG. 8 shows an example attachable string bender 100 attached to a guitar with a bridge 702 having six saddles in accordance with some implementations.

Figure 9:
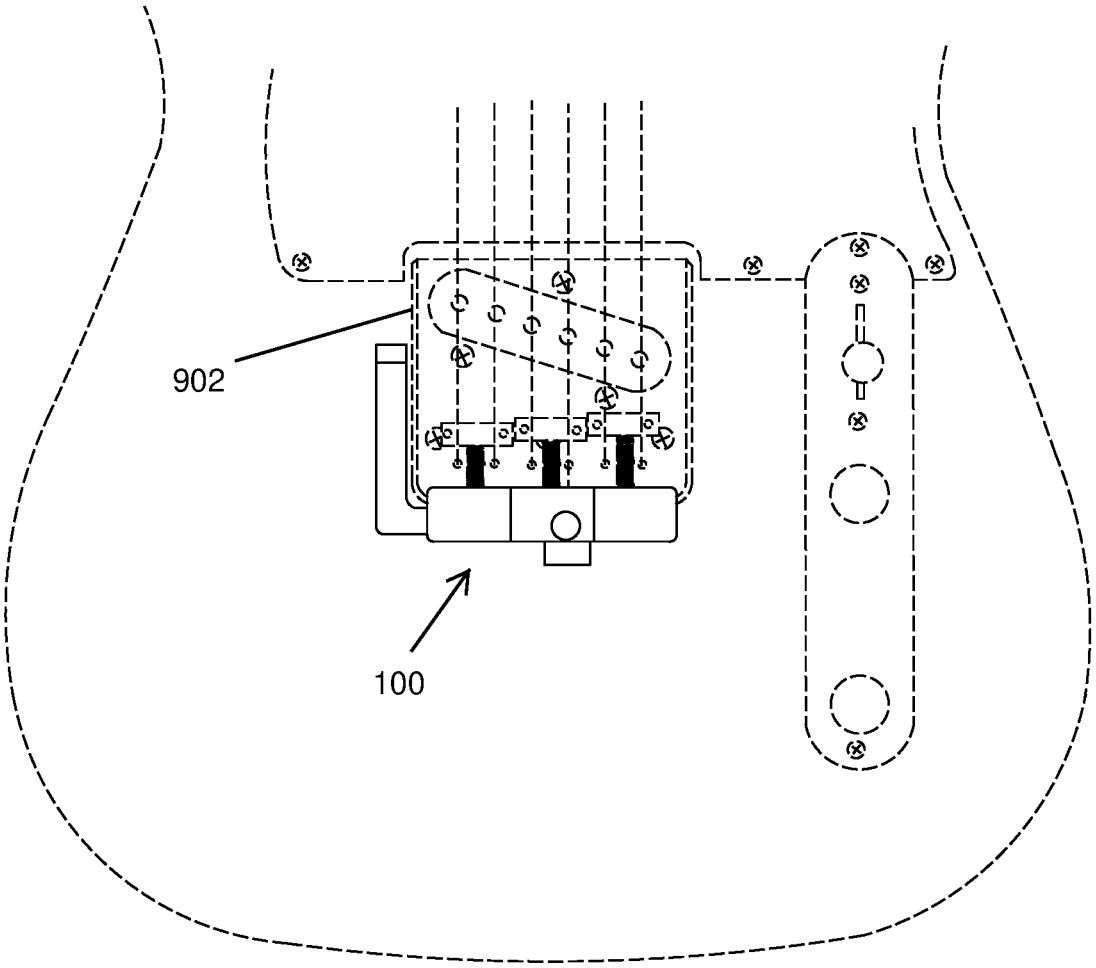
FIG. 9 shows an example attachable string bender attached to a guitar with a bridge having three saddles in accordance with some implementations.

FIG. 9 shows an example attachable string bender 100 attached to a guitar with a bridge 902 having three saddles in accordance with some implementations. The guitar shown in FIGS. 8 and 9 is similar to a Fender-style guitar.

The body 102 and/or cam 104 can be configured for a three- or six-saddle bridge configuration.

Figure 10:
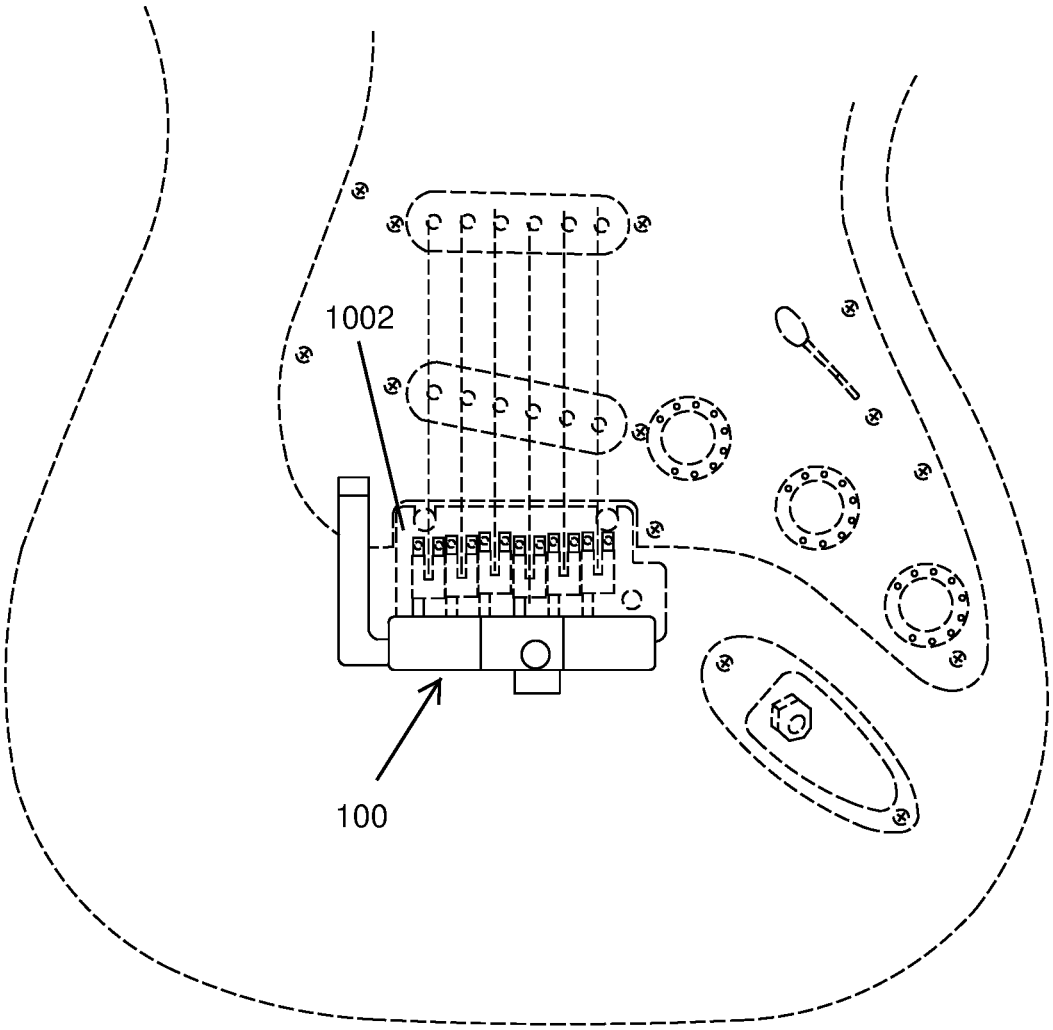
FIG. 10 shows an example attachable string bender attached to a guitar with a bridge having six saddles in accordance with some implementations.

FIG. 10 shows an example attachable string bender 100 attached to a guitar with a bridge 1002 having six saddles in accordance with some implementations.

Figure 11A:
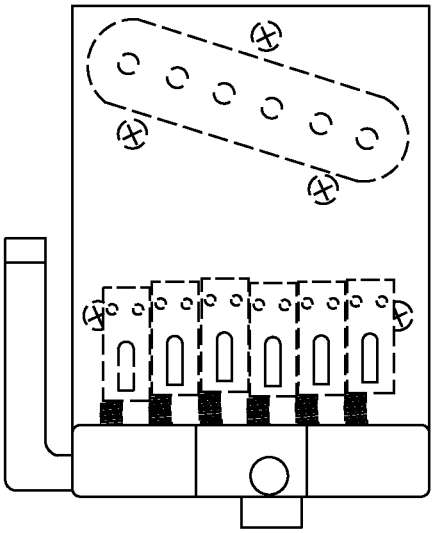
FIGS. 11A-11C show an example six-saddle bridge having an integrated string bender in accordance with some implementations.
Figure 11B:
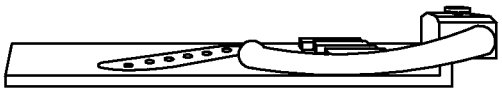
Figure 11C:
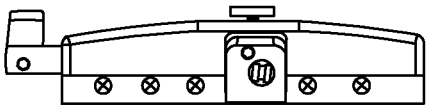

FIGS. 11A-11C shows an example six-saddle bridge having an integrated string bender in accordance with some implementations. The integrated string bender shown in FIGS. 11A-11C can include most of the parts described above in connection with the string bender 100, with the exception that the integrated string bender does not attach to an existing bridge, but rather replaces the entire bridge. Thus, the slots 120 and set screws 610 and 614 are not needed.

Figure 12A:
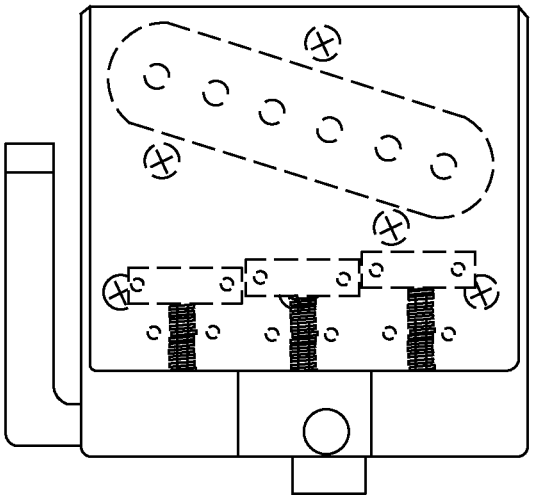
FIGS. 12A-12C show an example three-saddle bridge having an integrated string bender in accordance with some implementations.
Figure 12B:
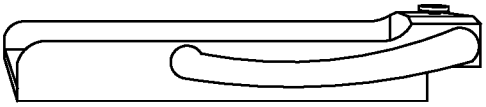
Figure 12C:
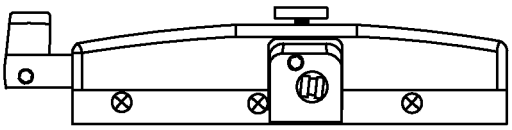

FIGS. 12A-12C shows an example three-saddle bridge having an integrated string bender in accordance with some implementations. The integrated string bender shown in FIGS. 12A-12C can include most of the parts described above in connection with the string bender 100, with the exception that the integrated string bender does not attach to an existing bridge, but rather replaces the entire bridge. Thus, the slots 120 and set screws 610 and 614 are not needed.

Figure 13:
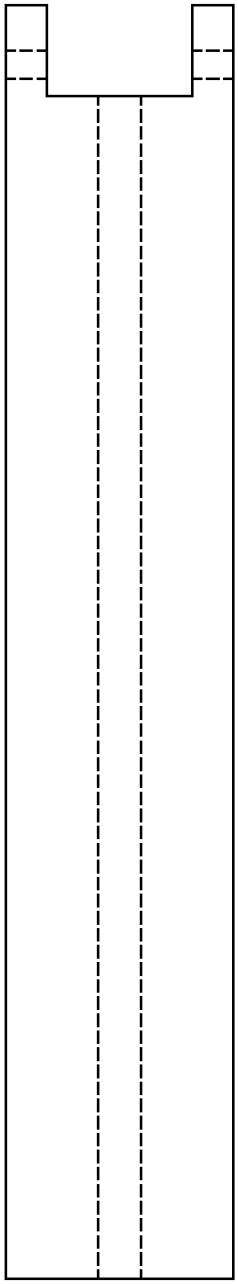
FIG. 13 shows an example installation tool in accordance with some implementations.

FIG. 13 shows an example installation tool in accordance with some implementations. The installation tool is configured to be placed on the bridge of a guitar to align an aperture of the tool with a location on the bridge to permit a hole to be drilled on the bridge to accommodate the string being bent to pass through the bridge and into the cam. The tool is optional and is not necessary for all guitar bridges, as some guitar bridges may already have a hole or holes that can be used as is for the string or strings being bent to pass through.

Figure 14:
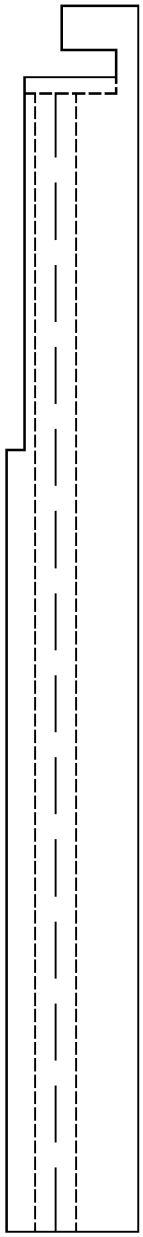
FIG. 14 shows a side view of the example installation tool in accordance with some implementations.

FIG. 14 shows a side view of the example installation tool in accordance with some implementations. The side view shows notches at the end of the tool that fit over the bridge. The two prongs extending from the tool permit the tool to be aligned on the bridge. The side view also shows a recessed area on the bottom of the tool to accommodate various types of bridges and corresponding spacing associated with the bridges.

Figure 15:
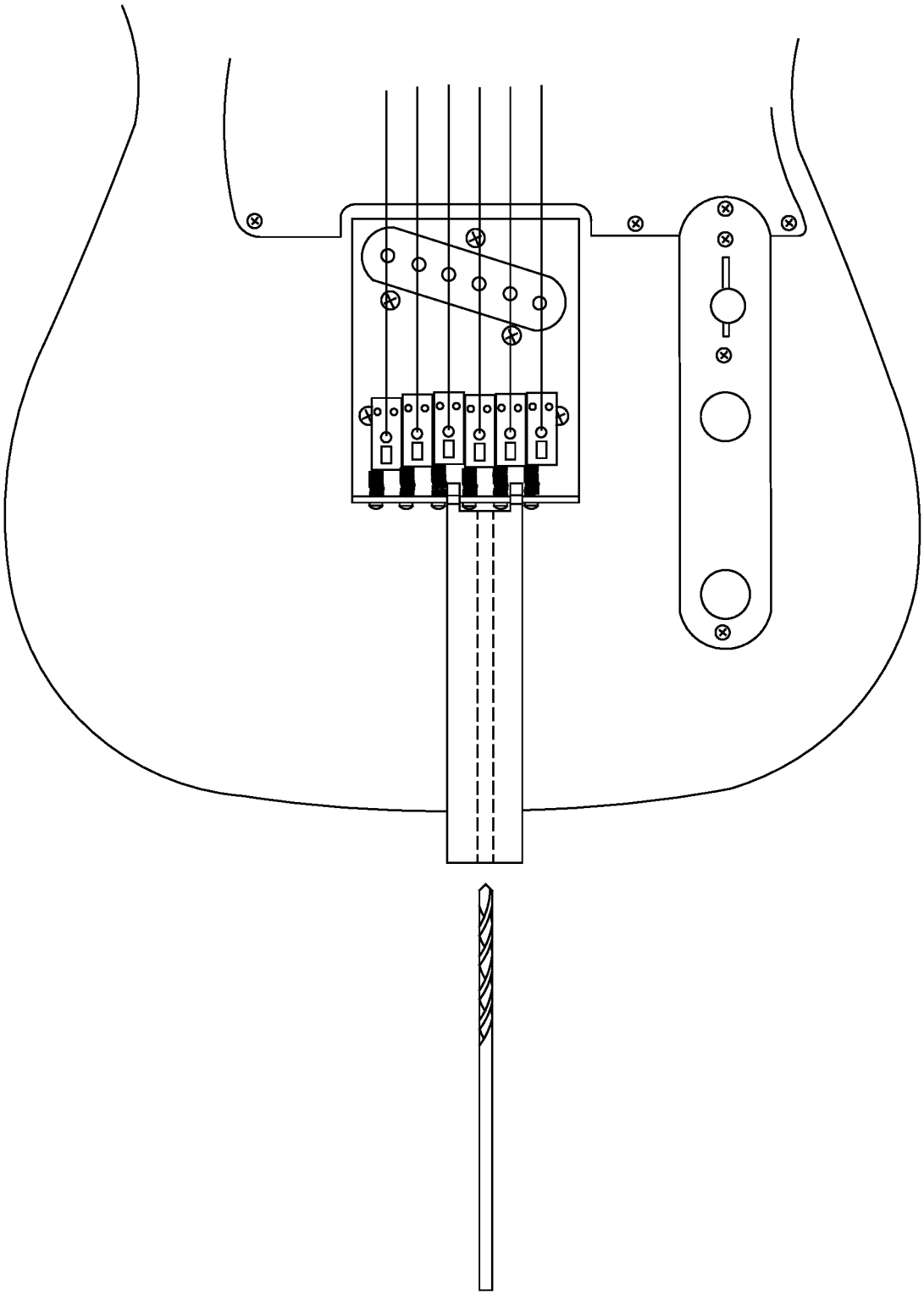
FIG. 15 shows the example installation tool in use on a guitar in accordance with some implementations.

FIG. 15 shows the example installation tool in use on a guitar in accordance with some implementations. The tool is shown aligned on the bridge and in position for the drill bit shown in FIG. 15. The tool is positioned to permit a hole to be drilled in the bridge to permit the g-string to pass through the hole in the bridge and on to the cam of the bender.

Figure 16:
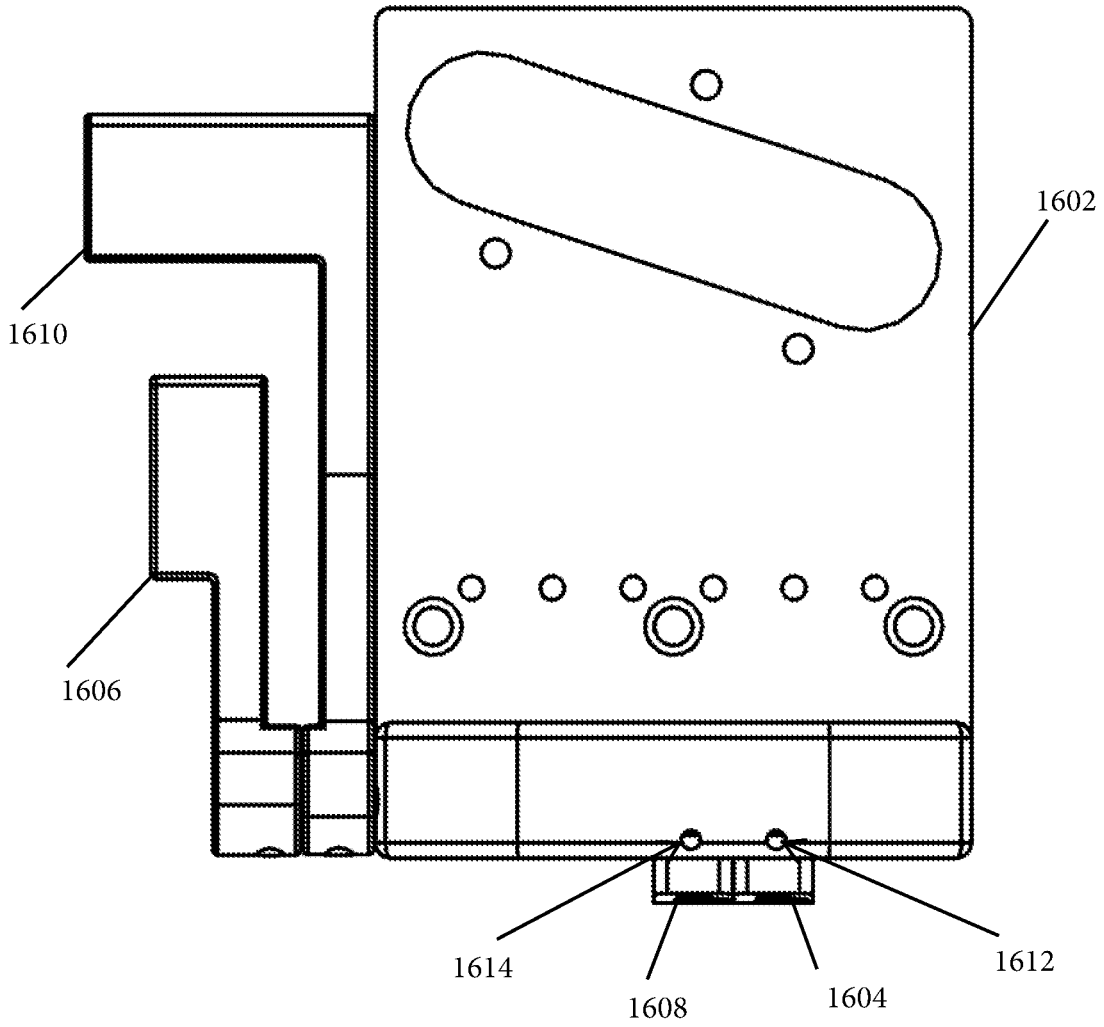
FIG. 16 is a top perspective view of an example six-saddle bridge having an integrated string bender with low profile style bars in accordance with some implementations.
Figure 17:
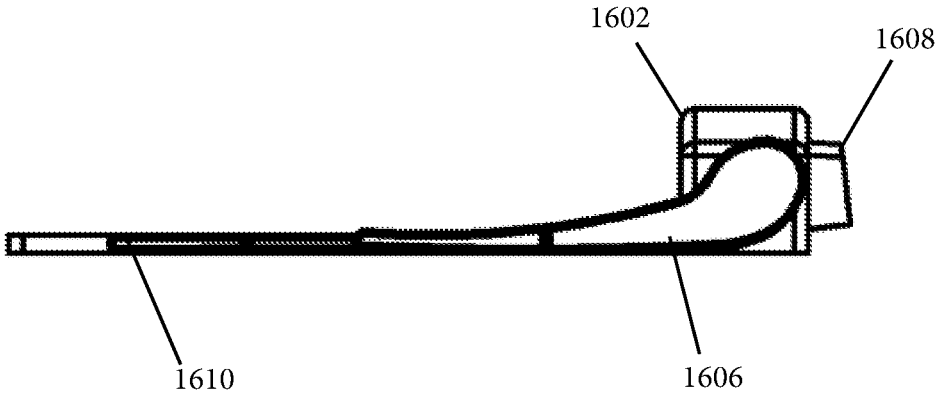
FIG. 17 is a side view of an example six-saddle bridge having an integrated string bender with low profile style bars in accordance with some implementations.

FIG. 16 shows a top perspective view of an example six-saddle bridge having an integrated string bender with low profile style bars in accordance with some implementations. The integrated string bender includes a body 1602, a first cam 1604, a second cam 1608, a first tuning screw aperture 1612, a second tuning screw aperture 1614, a first bar 1606, and a second bar 1610. FIG. 17 is a side view of an example six-saddle bridge having an integrated string bender with low profile style bars in accordance with some implementations.

Figure 18A:
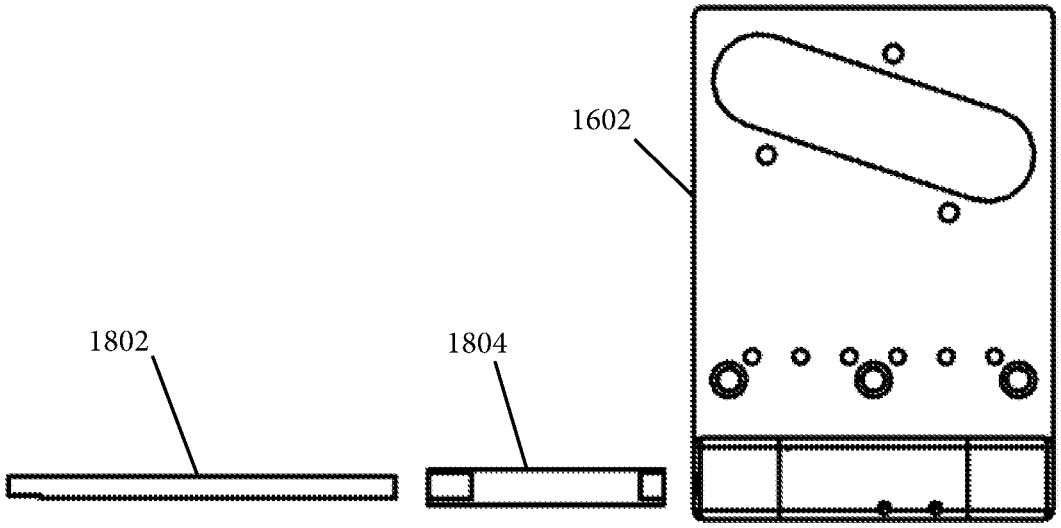
FIG. 18A is a top exploded view of an example six-saddle bridge having an integrated string bender in accordance with some implementations.
Figure 18B:
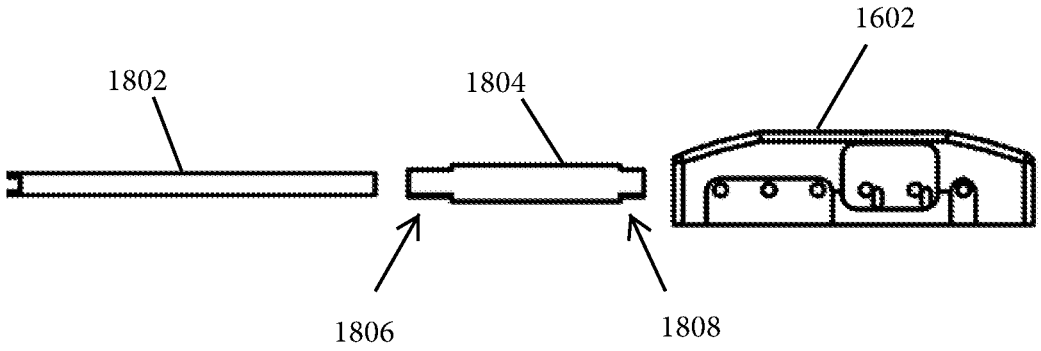
FIG. 18B is a back end exploded view of an example six-saddle bridge having an integrated string bender in accordance with some implementations.

FIGS. 18A and 18B show exploded views of an example six-saddle bridge having an integrated string bender in accordance with some implementations. The integrated string bender includes a body 1602, a rod 1802, a sleeve 1804 with a first notch 1806 and a second notch 1808.

Figure 19:
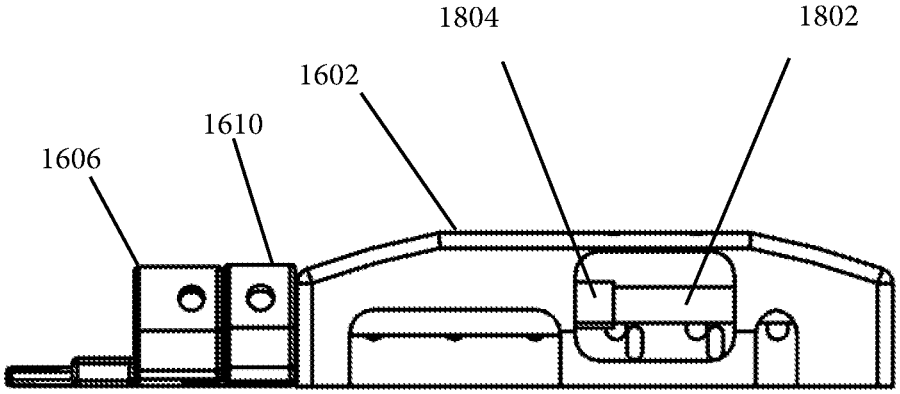
FIG. 19 is a back end view of an example six-saddle bridge having an integrated string bender with low profile style bars in accordance with some implementations.

FIG. 19 shows a back end view of an example six-saddle bridge having an integrated string bender with low profile style bars in accordance with some implementations. The integrated string bender includes a body 1602, a rod 1802, a sleeve 1804, a first bar 1606, and a second bar 1610.

Figure 20:
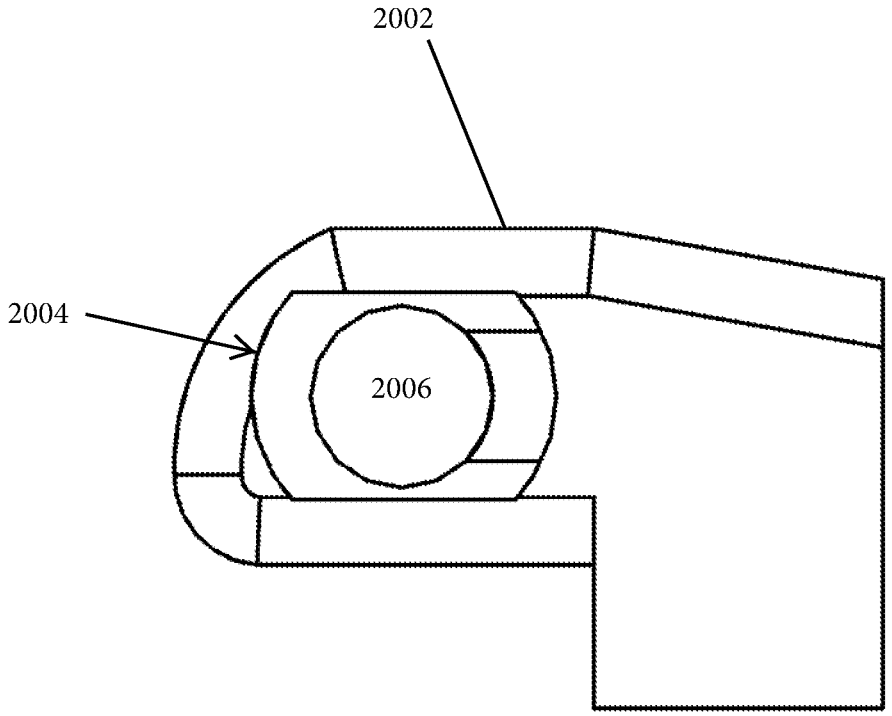
FIG. 20 is a right side view of an example string bender cam with key notch in accordance with some implementations.

FIG. 20 is a right side view of an example string bender cam with key notch in accordance with some implementations. The cam 2002 includes a cam rod aperture 2006 to permit the rod to pass through the cam 2002. A key notch 2004 to mate with notch 1808 on sleeve 1804.

Figure 21:
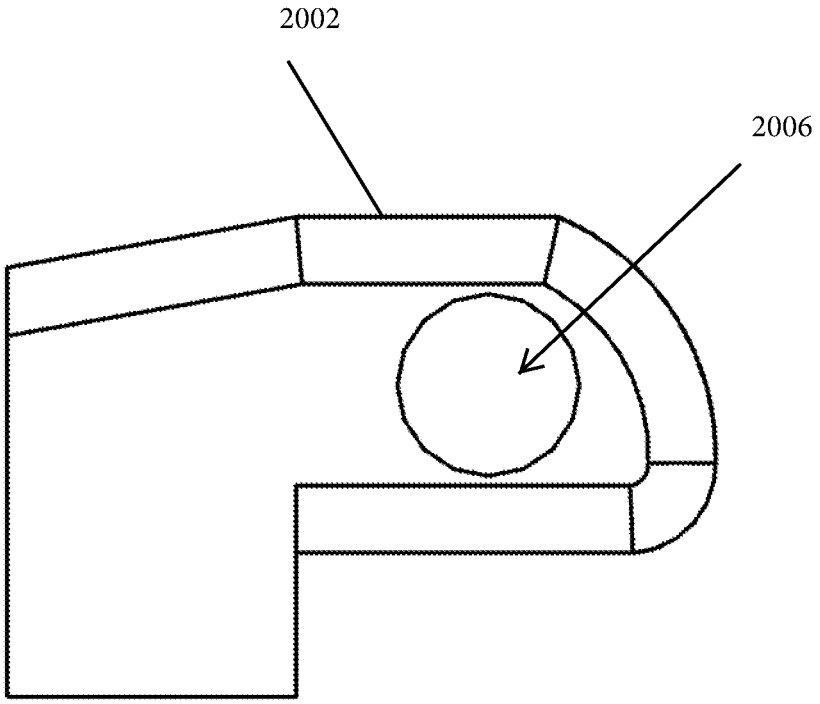
FIG. 21 is a left side view of an example string bender cam with key notch in accordance with some implementations.

FIG. 21 is a left side view of an example string bender cam with key notch in accordance with some implementations. The cam 2002 includes a cam rod aperture 2006 to permit the rod to pass through the cam 2002.

Some implementations can include one cam (to bend one string) or two cams (to bend two strings). By including a key notch 2004 and a cam rod aperture 2006, a first cam 2002 can be engaged by the sleeve 1804 via the key notch 2004 and notch 1808 on the sleeve 1804 and a second cam 2002 can be secured to the rod via a set screw inserted into the set screw aperture of the cam 2002. Thus, for example, one cam can be activated by the sleeve that is attached to a first bar and the second cam can be activated by the rod, which is secured to the second bar.

Figure 22:
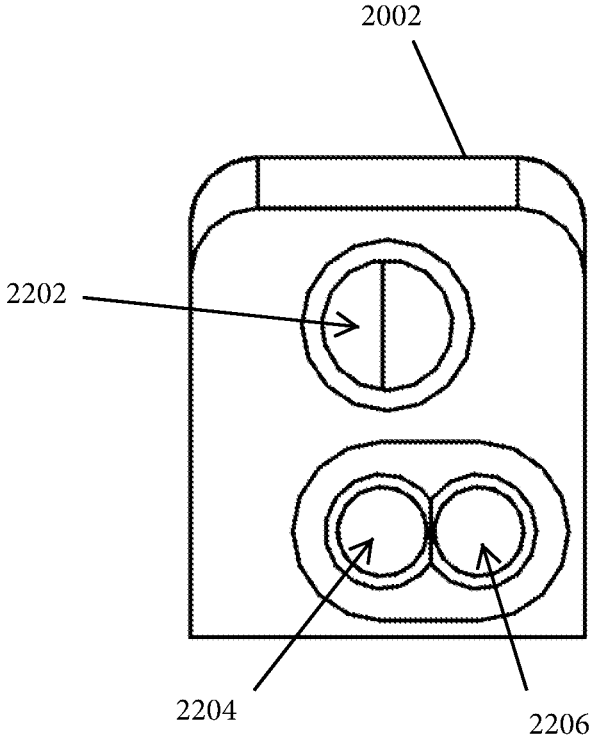
FIG. 22 is a back end view of an example string bender cam with key notch in accordance with some implementations.

FIG. 22 is a rear view of an example string bender cam with key notch in accordance with some implementations. The cam 2002 includes a first string aperture 2204 and a second string aperture 2206. The cam string apertures 2204 and 2206 provide two options for best alignment of the string for different styles of bridges. The cam string apertures 2204 and 2206 can be sized to permit the string to pass through while not permitting the string ball end to pass through, thus securing the string in place at the cam 2002. The cam 2002 also includes a cam set screw aperture 2202 that permits the cam to be secured to the rod passing through 2006.

Figure 23A:
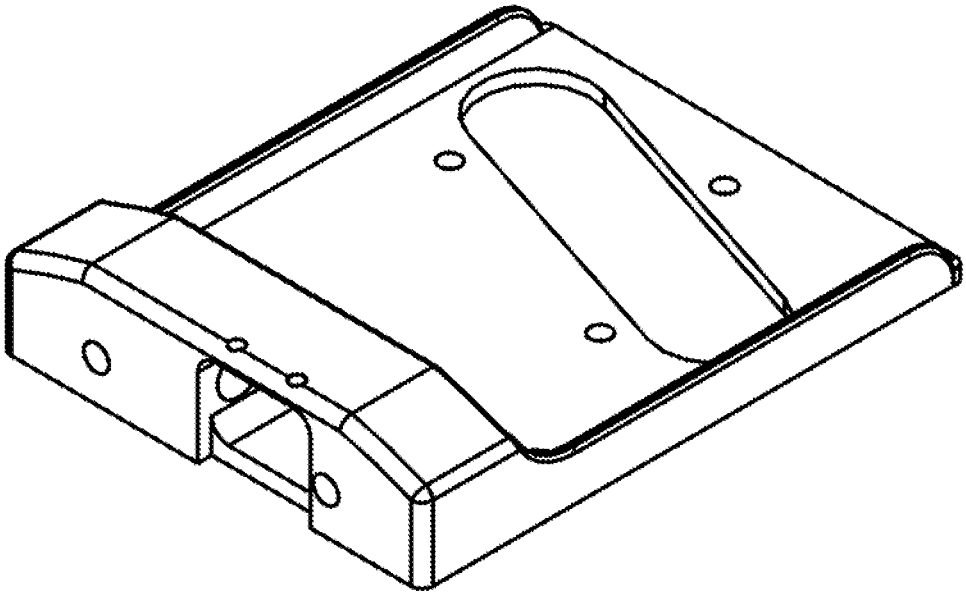
FIG. 23A is a top perspective view of an example three-saddle bridge having an integrated string bender body in accordance with some implementations.
Figure 23B:
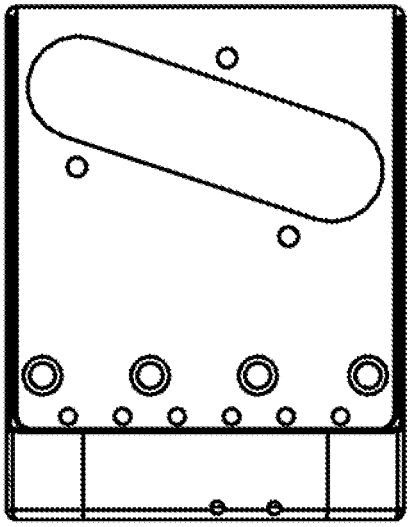
FIG. 23B is a top view of an example three-saddle bridge having an integrated string bender body in accordance with some implementations.
Figure 23C:
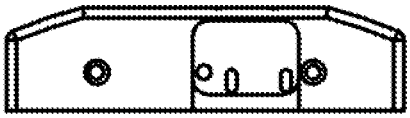
FIG. 23C is a back end view of an example three-saddle bridge having an integrated string bender body in accordance with some implementations.

FIG. 23A-23C shows an example three-saddle bridge having an integrated string bender body in accordance with some implementations. The integrated string bender shown in FIGS. 23A-23C can include most of the parts described above in connection with the string bender 100, with the exception that the integrated string bender does not attach to an existing bridge, but rather replaces the entire bridge. Thus, the slots 120 and set screws 610 and 614 are not needed.

Figure 24A:
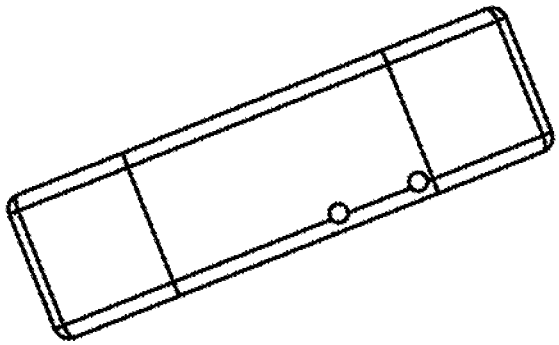
FIG. 24A is a top view of an example attachable string bender body in accordance with some implementations.
Figure 24B:
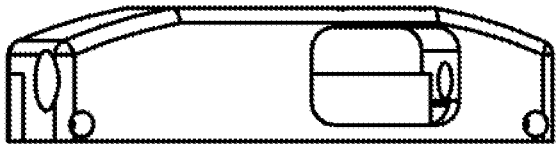
FIG. 24B is a back end perspective view of an example attachable string bender body in accordance with some implementations.
Figure 24C:
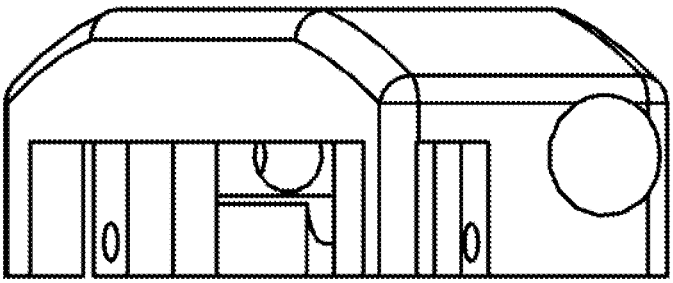
FIG. 24C is a front perspective view of an example attachable string bender body in accordance with some implementations.

FIG. 24A-24C shows an example attachable string bender body in accordance with some implementations.

Figure 25A:
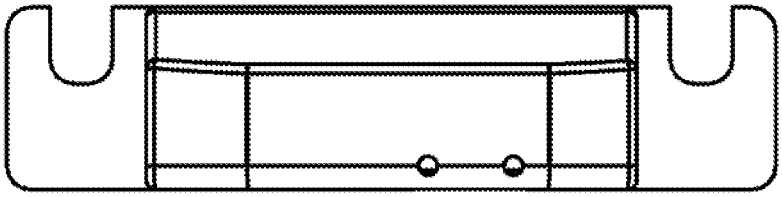
FIG. 25A is a top view of an example Gibson style string bender body in accordance with some implementations.
Figure 25B:
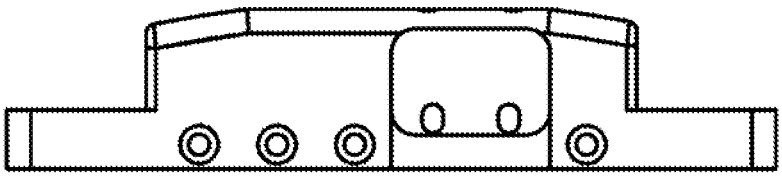
FIG. 25B is a back end view of an example Gibson style string bender body in accordance with some implementations.
Figure 25C:
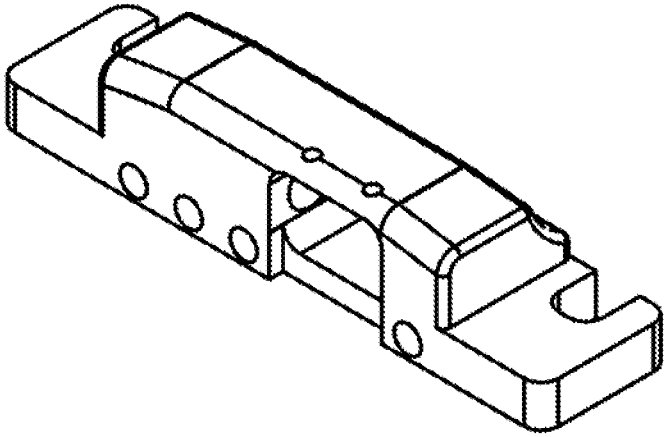
FIG. 25C is a top perspective view of an example Gibson style string bender body in accordance with some implementations.

FIG. 25A-25C shows an example Gibson-style string bender body in accordance with some implementations.

Figure 26:
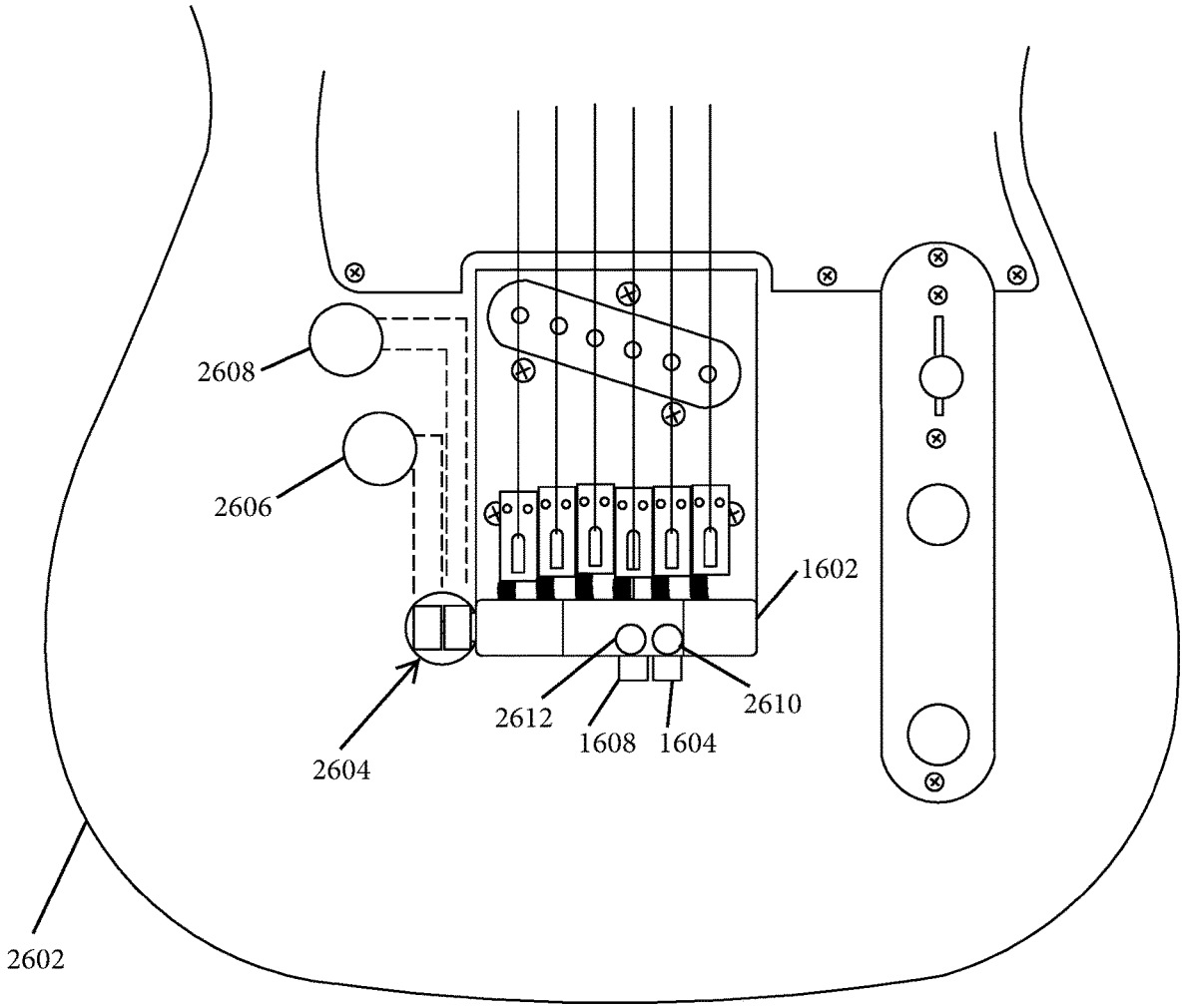
FIG. 26 is a top view of an example six saddle string bender with router style bars in use on a guitar in accordance with some implementations.

FIG. 26 shows an example six saddle integrated string bender with router style bars in use on a guitar in accordance with some implementations. The integrated string bender shown in FIG. 26 includes a body 1602, a first cam 1604, a second cam 1608, a first tuning screw 2610, a second tuning screw 2612, a first bar 2606, and a second bar 2608, a guitar body 2602, and a bar access aperture 2604. The first bar 2606 and the second bar 2608 pass from the integrated string bender through the guitar, along channels in the back of the guitar (e.g., routed out channels) and then back up through the guitar to the front of the guitar.

Figure 27:
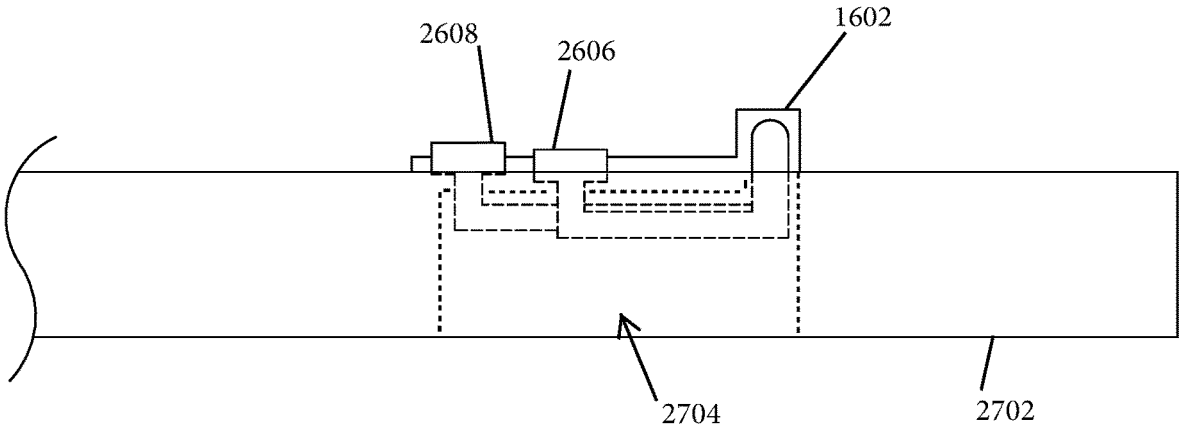
FIG. 27 is a side view of an example six saddle string bender with router style bars in use on a guitar in accordance with some implementations.

FIG. 27 is a side view of an example six saddle integrated string bender with router style bars in use on a guitar in accordance with some implementations. The integrated string bender shown in FIG. 27 includes a body 1602, a first bar 2606, and a second bar 2608, a guitar body 2702, and a bar access void 2704.

Figure 28:
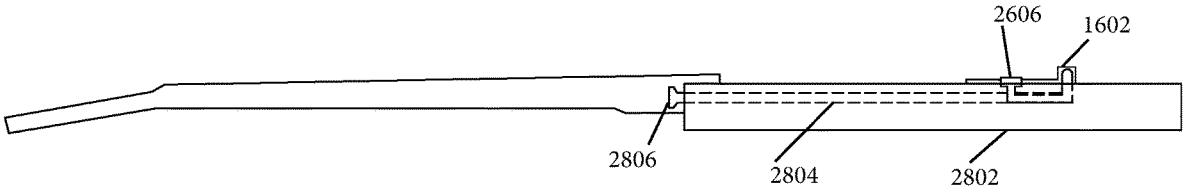
FIG. 28 is a side view of an example six saddle string bender with a router style bar and a strap lever in use on a guitar in accordance with some implementations.

FIG. 28 is a side view of an example six saddle integrated string bender with a router style bar and a strap lever in use on a guitar in accordance with some implementations. The integrated string bender shown in FIG. 28 includes a body 1602, a first bar 2606, and a second bar 2806, a guitar body 2802, and a bar access void 2804.

The first bar 2806 passes through the guitar as described above regarding bar 2606 and the second bar 2806 can be configured so that it is attached to the strap of the guitar and is controlled by pushing the guitar in a downward direction applying pressure to the strap causing the second bar 2806 to move and cause one of the cams to rotate.

It is, therefore, apparent that there is provided, in accordance with the various embodiments disclosed herein, string benders for stringed instruments.

While the disclosed subject matter has been described in conjunction with a number of embodiments, it is evident that many alternatives, modifications and variations would be or are apparent to those of ordinary skill in the applicable arts. Accordingly, Applicant intends to embrace all such alternatives, modifications, equivalents and variations that are within the spirit and scope of the disclosed subject matter.

What is claimed is:

1. A string bender comprising:

a body configured to mount on a bridge of a guitar and to be secured using one or more attachment fasteners inserted through corresponding attachment apertures in the body;

a cam configured to fit within a first aperture of the body and to secure a string of the guitar, wherein when the cam is rotated from a first position to a second position, the cam changes tension of the string;

a rod configured to be inserted into a second aperture of the body and to extend through an aperture in the cam, wherein the rod includes a portion that extends beyond the body when the rod is fully inserted into the second aperture of the body, and wherein the cam includes a set screw to secure the cam to the rod; and a bar configured to attach to the portion of the bar that extends beyond the body, wherein the bar is attached to the rod via a set screw, wherein the bar is disposed on the body adjacent a side of the guitar corresponding to a lowest pitch string of the guitar toward a top of the guitar and extends in a direction from the bridge toward a neck of the guitar, and wherein the bar is operative to rotate the rod and, in turn, the cam from the first position to the second position when the bar is pressed.

2. The string bender of claim 1, further comprising a tuning adjustment screw configured to be inserted into a tuning screw aperture in the body, wherein the tuning adjustment screw is configured to extend through the tuning screw aperture in the body and into the first aperture of the body, and wherein the tuning adjustment screw is adjustable to limit a range of movement of the cam within the first aperture of the body when the cam moves from the first position to the second position.

3. The string bender of claim 1, wherein the body includes one or more slots formed to receive a portion of the bridge of the guitar that extends into the one or more slots when the body is mounted on the bridge, and wherein the attachment fasteners are disposed so as to engage the portion of the bridge extending into the one or more slots when the attachment fasteners are tightened.

4. The string bender of claim 1, wherein the cam is configured to secure the string via a string aperture in the cam that string passes through.

5. The string bender of claim 1, wherein the bar includes a curved profile.

6. The string bender of claim 2, wherein the tuning screw aperture is disposed on a top side of the body.

7. A string bender comprising:

a body configured to mount on a bridge of a stringed instrument and to be secured using one or more attachment fasteners inserted through corresponding attachment apertures in the body;

a cam configured to fit within a first aperture of the body and to secure a string of the stringed instrument, wherein when the cam is rotated from a first position to a second position, the cam changes tension of the string;

a rod configured to be inserted into a second aperture of the body and to extend through an aperture in the cam, wherein the rod includes a portion that extends beyond the body when the rod is fully inserted into the second aperture of the body, and wherein the cam includes a set screw to secure the cam to the rod; and a bar configured to attach to the portion of the rod that extends beyond the body, wherein the bar is attached to the rod via a set screw, wherein the bar is disposed on the body adjacent a side of the stringed instrument corresponding to a lowest pitch string of the stringed instrument toward a top of the stringed instrument and extends in a direction from the bridge toward a neck of the stringed instrument, and wherein the bar is operative to rotate the rod and, in turn, the cam from the first position to the second position when the bar is pressed.

8. The string bender of claim 7, further comprising a tuning adjustment screw configured to be inserted into a tuning screw aperture in the body, wherein the tuning adjustment screw is configured to extend through the tuning screw aperture in the body and into the first aperture of the body, and wherein the tuning adjustment screw is adjustable to limit a range of movement of the cam within the first aperture of the body when the cam moves from the first position to the second position.

9. The string bender of claim 7, wherein the body includes one or more slots formed to receive a portion of the bridge of the stringed instrument that extends into the one or more slots when the body is mounted on the bridge, and wherein the attachment fasteners are disposed so as to engage the portion of the bridge extending into the one or more slots when the attachment fasteners are tightened.

10. The string bender of claim 7, wherein the cam is configured to secure the string via a string aperture in the cam that string passes through.

11. The string bender of claim 7, wherein the bar includes a curved profile.

12. The string bender of claim 8, wherein the tuning screw aperture is disposed on a top side of the body.

* * * * *